US007960667B2

(12) United States Patent
Yoshihara et al.

(10) Patent No.: US 7,960,667 B2
(45) Date of Patent: Jun. 14, 2011

(54) MOVABLE CONTACT ELEMENT AND SWITCH USING THE SAME

(75) Inventors: Satoshi Yoshihara, Hyogo (JP); Tamotsu Yamamoto, Hyogo (JP); Masaki Sawada, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/117,057

(22) Filed: May 8, 2008

(65) Prior Publication Data

US 2008/0296140 A1 Dec. 4, 2008

(30) Foreign Application Priority Data

Jun. 4, 2007 (JP) ..... 2007-147660
Nov. 7, 2007 (JP) ..... 2007-289486

(51) Int. Cl.
*H01H 1/10* (2006.01)

(52) U.S. Cl. ..... 200/516; 200/5 R

(58) Field of Classification Search ..... 200/513, 200/516, 5 R, 5 D
See application file for complete search history.

(56) References Cited

U.S. PATENT DOCUMENTS

| | | | | |
|---|---|---|---|---|
| 4,315,238 | A | 2/1982 | Eventoff | |
| 4,463,234 | A | 7/1984 | Bennewitz | |
| 5,296,837 | A * | 3/1994 | Yaniger | 338/47 |
| 5,760,352 | A | 6/1998 | Ishihara et al. | |
| 6,080,941 | A * | 6/2000 | Yokobori | 200/6 A |
| 6,351,205 | B1 * | 2/2002 | Armstrong | 338/114 |
| 6,670,562 | B2 * | 12/2003 | Kaneko | 200/1 B |

FOREIGN PATENT DOCUMENTS

| | | | |
|---|---|---|---|
| BE | 1015276 | A3 | 12/2004 |
| CN | 1148254 | A | 4/1997 |
| CN | 1460910 | A | 12/2003 |
| EP | 0441993 | A | 8/1991 |
| JP | 11039983 | A | 2/1999 |
| JP | 11039984 | A | 2/1999 |
| JP | 2003-123596 | | 4/2003 |
| JP | 2003-331681 | A | 11/2003 |
| JP | 2003331681 | A | 11/2003 |
| JP | 2007012484 | A | 1/2007 |
| WO | 2005-116976 | | 12/2005 |

OTHER PUBLICATIONS

European Search Report.

* cited by examiner

*Primary Examiner* — Felix O Figueroa
(74) *Attorney, Agent, or Firm* — Pearne & Gordon LLP

(57) ABSTRACT

A movable contact element includes a cover sheet to which a movable contact having a dome shape is bonded and which is stacked on a top surface of a pressure sensitive conductive sheet. The movable contact element is bonded to a top surface of a substrate having a fixed contact formed thereon, thereby forming a switch. Through the construction, it is possible to obtain the movable contact element, which has a simple construction and can perform various operations, and the switch using the same.

5 Claims, 12 Drawing Sheets

MOVABLE CONTACT ELEMENT AND SWITCH USING THE SAME

BACKGROUND OF THE INVENTION

1. Technical Field

The present invention relates to a movable contact element used for operating various electronic apparatuses and a switch using the same.

2. Background Art

Recently, a variety of high-performance electronic apparatuses such as mobile phones or car navigation systems are being developed. With the development of electronic apparatuses, there is demand for a device which can perform various operations on a movable contact element used for operating the electronic apparatuses or a switch.

Such a conventional movable contact element and a switch using the same will be described with reference to FIG. 15.

FIG. 15 is a cross-sectional view of conventional switch 150. In FIG. 15, switch 150 has movable contact element 104, substrate 105, and fixed contacts 106. Movable contact element 104 has cover sheet 101 and movable contacts 102. Cover sheet 101 with flexibility is formed in a film shape. Each of movable contacts 102 is formed in substantially a dome shape and is made of a conductive thin metal plate. The plurality of movable contacts 102 are bonded to the lower surface of cover sheet 101 by using adhesive 103, thereby forming movable contact element 104.

Substrate 105 has a plurality of wiring patterns (not shown) formed on a top surface and a lower surface thereof. Each of fixed contacts 106 is composed of central fixed contact 106A (hereinafter, referred to as contact 106A) and outer fixed contact 106B (hereinafter, referred to as contact 106B). Contact 106A has a circular shape and is formed on a top surface of substrate 105. Contact 106B has a horseshoe shape and is formed on the top surface of substrate 105 so as to surround contact 106A. As such, the plurality of fixed contacts 106 are provided on the top surface of substrate 105.

Cover sheet 101 is bonded to the top surface of substrate 105, and the outer periphery of movable contact 102 is loaded on contact 106B. Further, the central portion of the lower surface of movable contact 102 is disposed to face contact 106A with a predetermined gap therebetween. In such a manner, switch 150 is constructed.

Switch 150 constructed in such a manner is mounted on an operating portion of an electronic apparatus (not shown), and an operation body (not shown) is disposed above switch 150 so as to move up and down or swing. Further, the plurality of fixed contacts 106 are connected to an electronic circuit (not shown) of the electronic apparatus through the wiring patterns.

In such a construction, the operation body is pressed or swung. Then, the lower surface of the pressed or swung operation body presses a top surface of cover sheet 101. When the top surface of cover sheet 101 is pressed, cover sheet 101 is bent. Further, the dome-shaped central portion of movable contact 102 is pressed. When a predetermined pressing force is applied to movable contact 102, movable contact 102 is elastically inverted downward with a click feeling such that a central portion of a lower surface of movable contact 102 comes in contact with contact 106A. Accordingly, contact 106A and contact 106B are electrically connected to each other through movable contact 102.

When the pressing force applied to the operation body is released, movable contact 102 elastically restores upward by an elastic restoring force of movable contact 102, and the central portion of the lower surface of movable contact 102 is separated from contact 106A. Accordingly, the electrical connection between contact 106A and contact 106B is cut off.

The electronic circuit of the electronic apparatus detects the electrical connection and disconnection among the plurality of fixed contacts 106. For example, when the operation body is operated upward in a state where a plurality of menus are displayed on a display screen (not shown) such as a liquid crystal display element of an electronic apparatus, a cursor or pointer displayed on the display screen is moved upward by a predetermined distance.

Further, when the operation body is operated in the right direction, the electronic circuit detects the electrical connection and disconnection of fixed contact 106 positioned in the vicinity of the operated operation body. Then, the cursor or pointer displayed on the display screen is moved in the right direction by a predetermined distance.

That is, as the operation body is pressed or swung, movable contact 102 under the operated operation body is elastically inverted, and the electrical connection and disconnection of fixed contacts 106 is performed. Further, the electronic circuit of the electronic apparatus detects at which place the electrical connection and disconnection of fixed contacts 106 is performed. Accordingly, the operation or switching of functions of the electronic apparatus is performed in accordance with the operation of the operation body.

Such conventional switch 150 is disclosed in Japanese Patent Unexamined Publication No. 2003-123596, for example.

However, in conventional movable contact element 104 and switch 150 using the same, a large number of movable contacts 102 and fixed contacts 106 are needed to execute various operations. Further, an operation body having a complicated shape is also required. Therefore, the number of parts composing switch 150 increases, and the construction of switch 150 becomes complicated. As a result, movable contact 102 and switch 150 become expensive.

SUMMARY OF THE INVENTION

The present invention provides a movable contact element, which has a simple construction and can perform various operations, and a switch using the same.

The movable contact element according to the present invention includes a movable contact having a dome shape, a cover sheet, and a pressure sensitive conductive sheet. On a lower surface of the cover sheet, the movable contact is bonded. On a top surface of the pressure sensitive conductive sheet, the cover sheet is stacked. Through such a construction, it is possible to obtain a movable contact element which has a simple construction and can perform various operations.

Further, the switch according to the present invention includes a substrate, a movable contact element, and a fixed contact. The movable contact element has a movable contact having a dome shape, a cover sheet having the movable contact bonded to its lower surface, and a pressure conductive sheet having the cover sheet stacked on its top surface. The fixed contact is formed on a top surface of the substrate so as to face a lower surface of the pressure sensitive conductive sheet. Through such a construction, it is possible to obtain a switch which has a simple construction and can perform various operations.

DETAILED DESCRIPTION OF PREFERRED EMBODIMENTS

Hereinafter, preferred embodiments of the present invention will now be described with reference to FIGS. 1 to 14.

First Embodiment

A first embodiment of the present invention will be described with reference to FIGS. 1 to 8.

Figure 1:
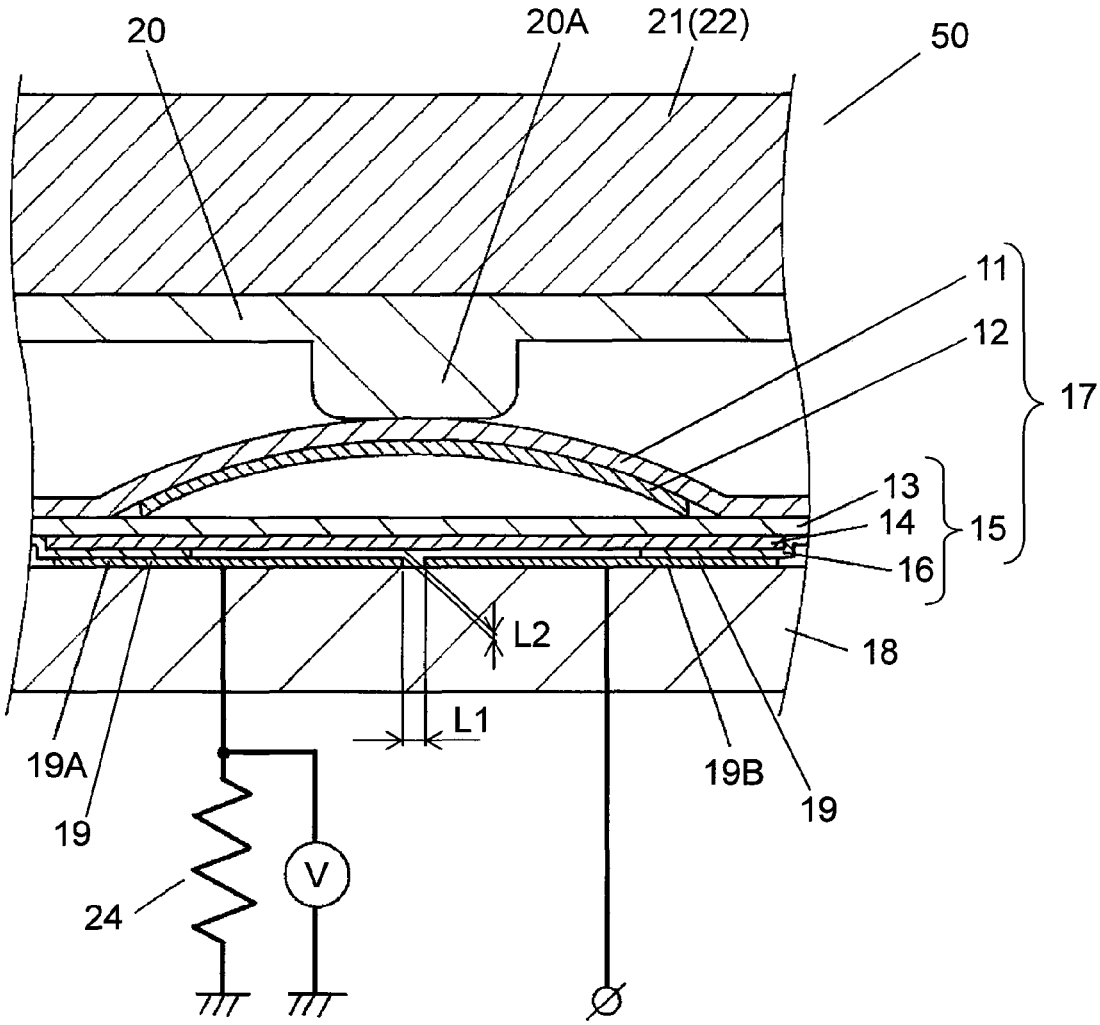
FIG. 1 is a cross-sectional view of a switch according to a first embodiment of the present invention.
Figure 2:
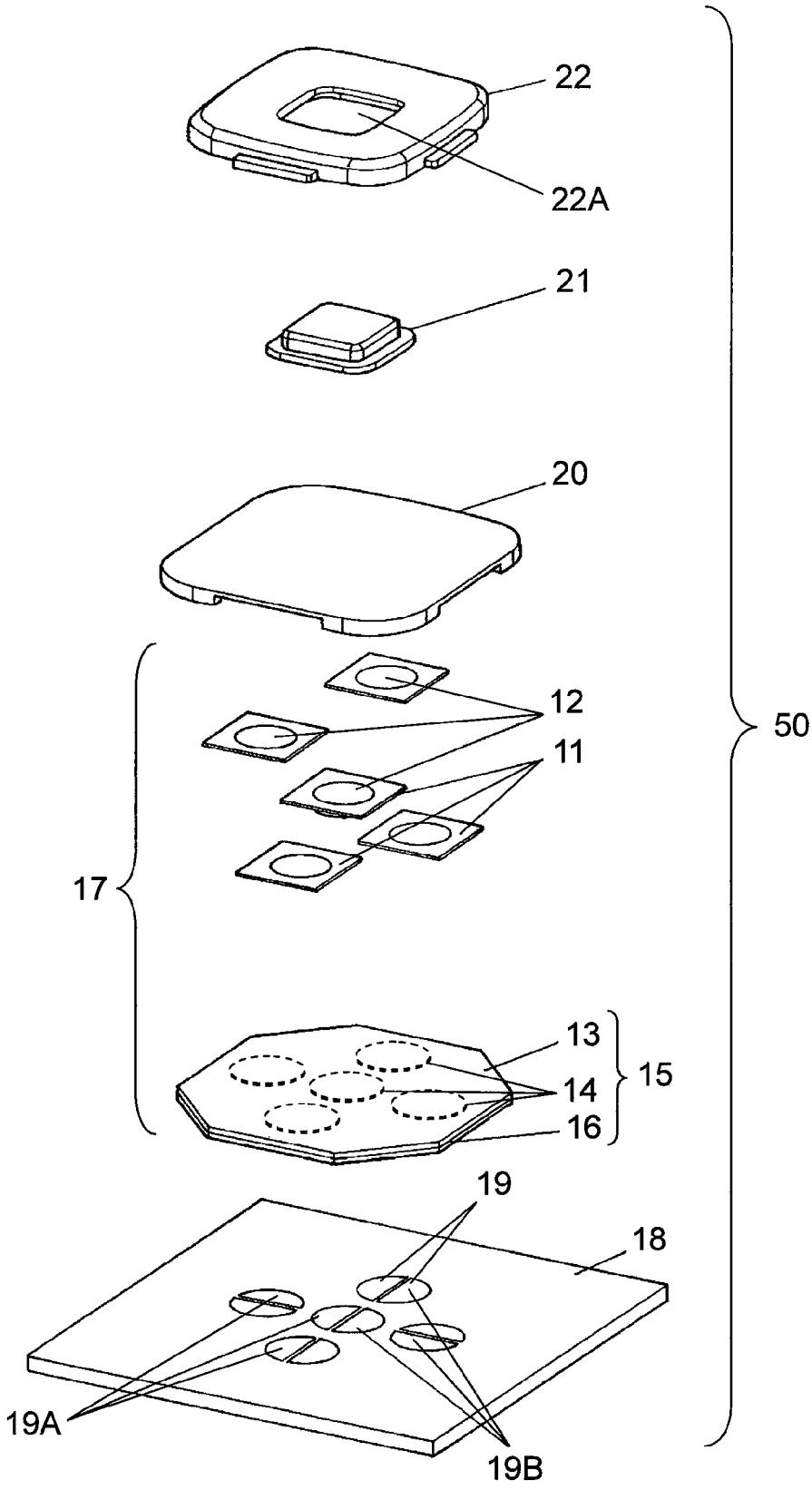
FIG. 2 is an exploded perspective view of the switch shown in FIG. 1.
Figure 3A:
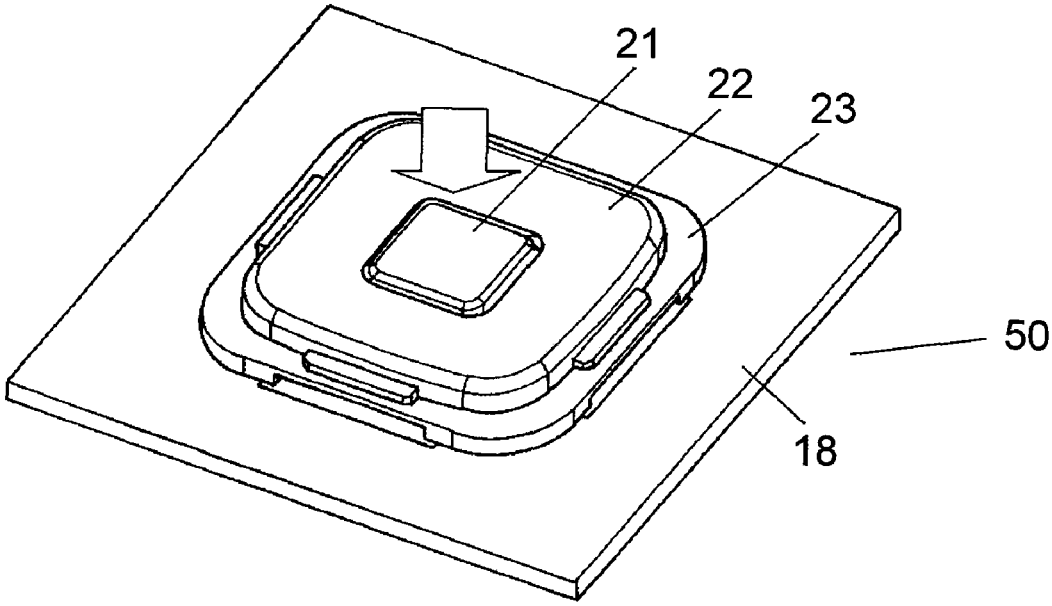
FIG. 3A is a perspective view of the switch shown in FIG. 1.
Figure 3B:
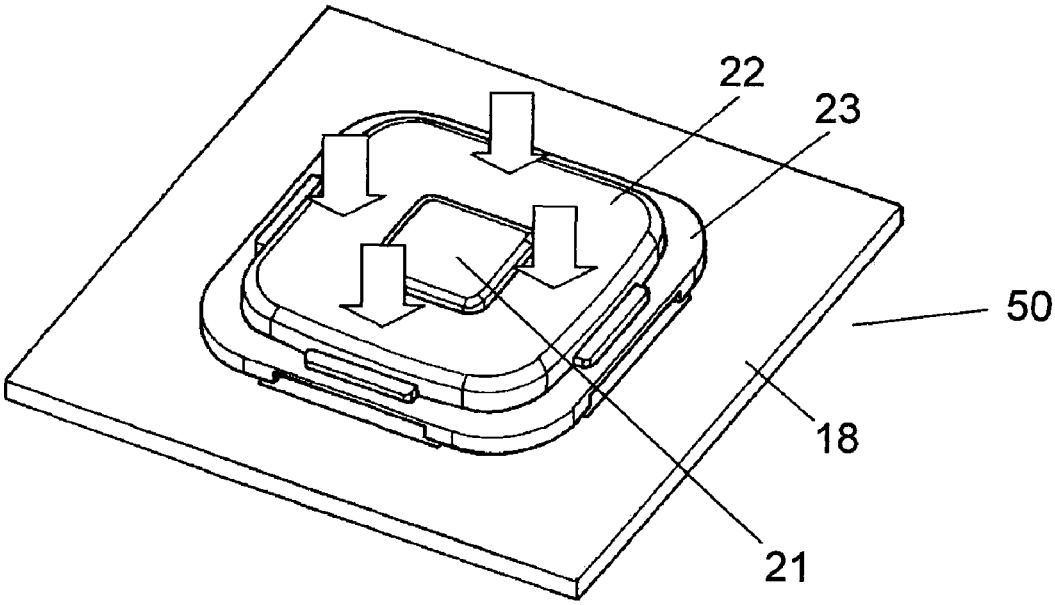
FIG. 3B is a perspective view of the switch shown in FIG. 1.
Figure 4:
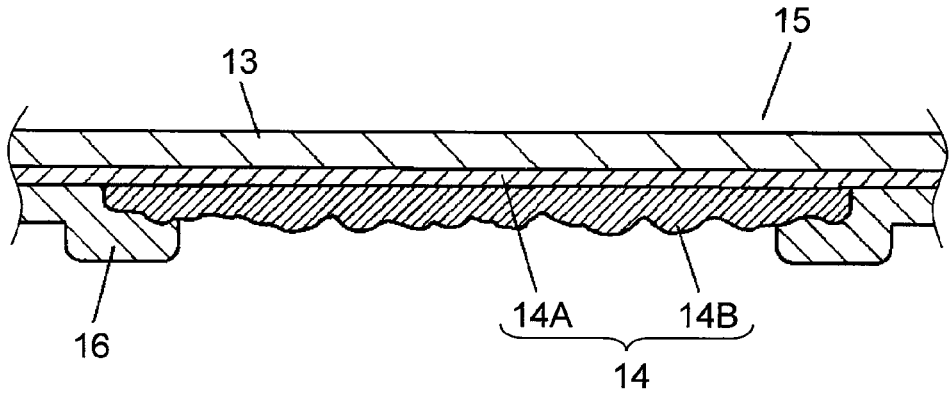
FIG. 4 is a cross-sectional view of a pressure sensitive conductive sheet used in the switch shown in FIG. 1.
Figure 5:
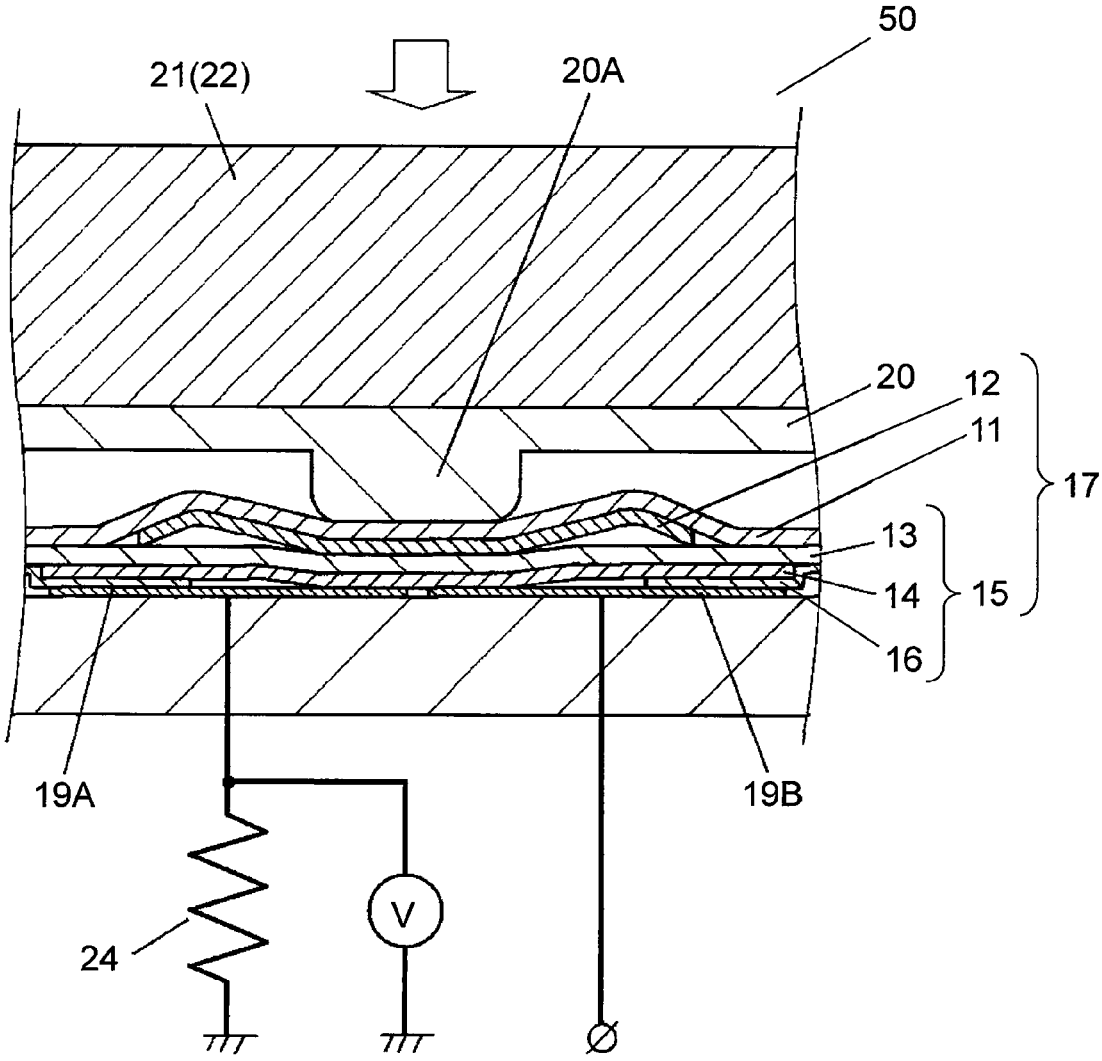
FIG. 5 is a cross-sectional view of the switch shown in FIG. 1 when a pressing operation is performed.
Figure 6:
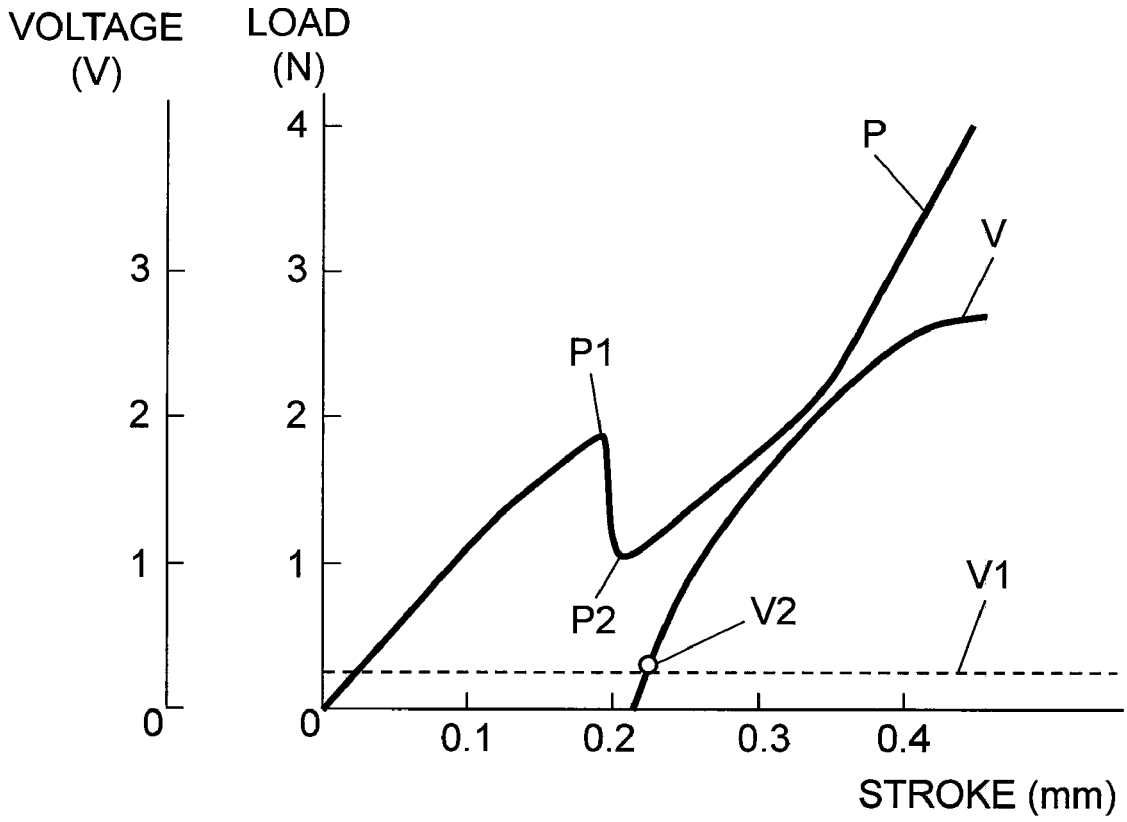
FIG. 6 is a graph showing characteristics of the switch shown in FIG. 1.
Figure 7A:
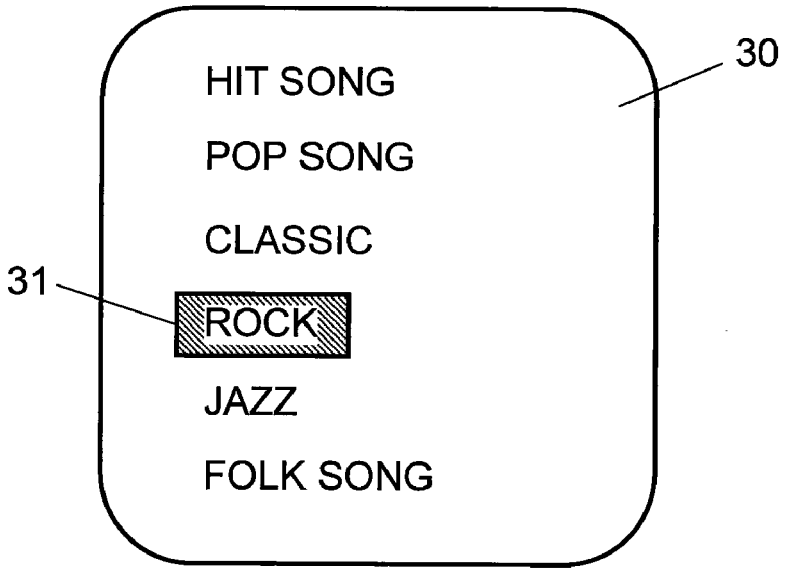
FIG. 7A is a plan view of a display screen of an electronic apparatus on which the switch shown in FIG. 1 is mounted.
Figure 7B:
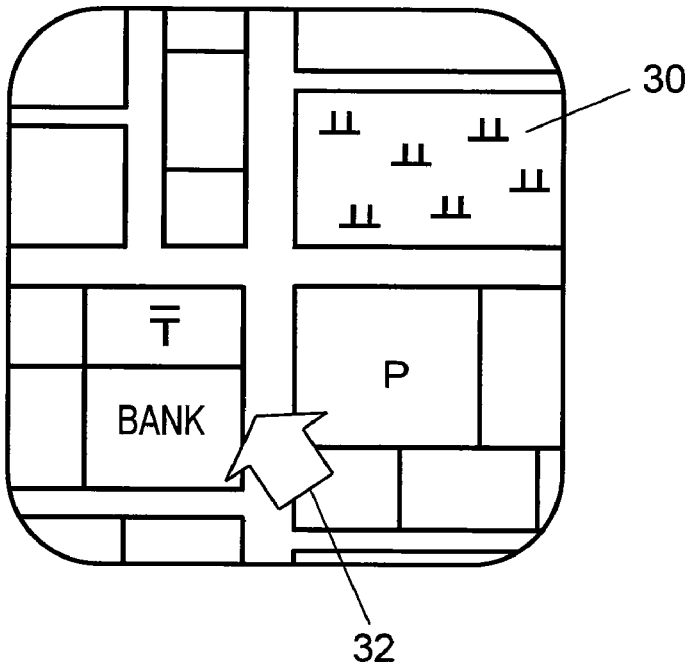
FIG. 7B is a plan view of another type of a display screen of the electronic apparatus on which the switch shown in FIG. 1 is mounted.
Figure 8A:
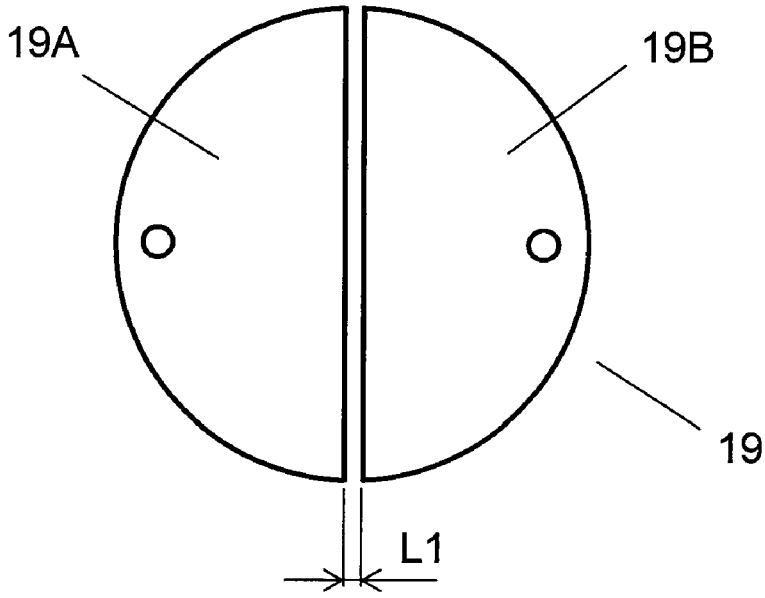
FIG. 8A is a plan view of a fixed contact used in the switch shown in FIG. 1.
Figure 8B:
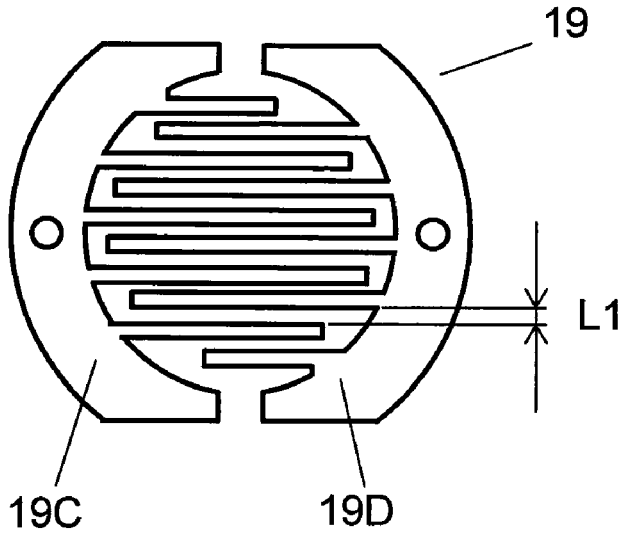
FIG. 8B is a plan view of another type of fixed contact used in the switch shown in FIG. 1.

FIG. 1 is a cross-sectional view of switch 50 according to the first embodiment of the present invention. FIG. 2 is an exploded perspective view of switch 50. FIGS. 3A and 3B are perspective views of switch 50. FIG. 4 is a cross-sectional view of pressure sensitive conductive sheet 15 (hereinafter, referred to as sheet 15) used in switch 50. FIG. 5 is a cross-sectional view of switch 50 when a pressing operation is performed. FIG. 6 is a graph showing characteristics of switch 50. FIG. 7A is a plan view of display screen 30 of an electronic apparatus (not shown) on which switch 50 is mounted. FIG. 7B is a plan view of another type of display screen 30 of the electronic apparatus on which switch 50 is mounted. FIG. 8A is a plan view of fixed contact 19 used in switch 50. FIG. 8B is a plan view of another type of fixed contact 19 used in switch 50.

As shown in FIGS. 1 and 2, switch 50 has movable contact element 17, substrate 18, and fixed contacts 19. Movable contact element 17 has cover sheets 11, movable contacts 12, and sheet 15. Each of cover sheets 11 made of polyethylene terephthalate, polycarbonate, polyimide, or the like is formed in a film shape and has flexibility. Each of movable contacts 12 is formed in substantially a dome shape and is made of a conductive metal thin plate such as a copper alloy or steel. Further, movable contact 12 is bonded to a lower surface of cover sheet 11 by using an adhesive (not shown) such as acrylic resin or silicone. Further, cover sheet 11 has an electrical insulating property.

Sheet 15 has base sheet 13 and pressure sensitive conductive layer 14 (hereinafter, referred to as conductive layer 14). Base sheet 13 made of the same material as that of cover sheet 11 has flexibility and is formed in a film shape. Conductive layer 14 is provided on a lower surface of base sheet 13. As shown in FIG. 4, conductive layer 14 has low resistor layer 14A and high resistor layer 14B having a higher resistance value than low resistor layer 14A. Low resistor layer 14A is a resistor layer, where carbon powder is dispersed into synthetic resin and whose sheet resistance value ranges from 0.5 to 30 kΩ/□ (ohms/square). High resistor layer 14B is provided on a lower surface of low resistor layer 14A, namely the lower surface of low resistor layer 14A is a side of fixed contacts 19. High resistor layer 14B is a resistor layer whose sheet resistance value ranges from 50 kΩ/□ to 5 MΩ/□. Further, a lower surface of high resistor layer 14B has minute surface irregularities formed thereon, namely the lower surface of high resistor layer 14B is a side of fixed contacts 19. Low resistor layer 14A and high resistor layer 14B are stacked by a printing method or the like, thereby forming conductive layer 14.

By bonding the plurality of cover sheets 11 on a top surface of sheet 15, the plurality of movable contacts 12 are loaded above conductive layer 14. Insulating layer 16 is formed on a portion of a lower surface of sheet 15, where conductive layer 14 is not formed, and a portion of a lower surface of conductive layer 14. Insulating layer 16 is formed of epoxy, polyester or the like. Further, insulating layer 16 may form a part of sheet 15.

Substrate 18 has a film shape or a plate shape. When substrate 18 has the film shape, such a material as polyethylene terephthalate or polycarbonate is used. When substrate 18 has the plate shape, such a material as paper phenol or glass epoxy is used. Further, substrate 18 has a plurality of wiring patterns (not shown) formed on top and lower surfaces thereof, the wiring patterns being made of copper foil or the like.

As shown in FIG. 8A, each of fixed contacts 19 has first fixed contact 19A (hereinafter, referred to as contact 19A) and second fixed contact 19B (hereinafter, referred to as contact 19B). Contacts 19A, 19B respectively have a substantially semi-circular shape. Contacts 19A, 19B made of carbon, silver, copper foil or the like are formed on a top surface of substrate 18. Further contacts 19A, 19B form a pair with a gap L1 of about 0.2 mm therebetween.

Movable contact element 17 is loaded on the top surface of substrate 18. Conductive layer 14 faces contacts 19A, 19B, with a gap L2 of 10 to 100 μm therebetween. The gap L2 may be formed based on a thickness of insulating layer 16. In this case, the dimension of the gap L2 can be easily controlled with precision.

Switch 50 further has rubber sheet 20, push button 21, operation body 22, and case 23. Rubber sheet 20 is formed of such a material as a silicone rubber and an elastomer. Push button 21 and operation body 22 are made of a resin having an electrical insulating property. On a lower surface of rubber sheet 20, a plurality of pressing portions 20A are formed so as to correspond to respective movable contacts 12. Each of pressing portions 20A contacts to a top surface of respective cover sheets 11 corresponding to the central portions of the plurality of movable contacts 12. Further, above pressing portions 20A, push button 21 is disposed to vertically move. Similarly, operation body 22 is swingably disposed above pressing portions 20A. Push button 21 is disposed in opening 22A formed in the central portion of operation body 22. Operation body 22 is disposed on substrate 18 by using case 23. In the above-described manner, switch 50 is constructed. Case 23 is made of a resin having an electrical insulating property.

Switch 50 constructed in such a manner is mounted on an operating portion (not shown) of an electronic apparatus. As shown in FIG. 2, the plurality of contacts 19A, 19B are formed on five places of substrate 18, that is, the center, left, right, top, and lower portions of the top surface of substrate 18. Movable contact element 17 is formed so as to correspond to contacts 19A, 19B. Functions implemented by rubber sheet 20, push button 21, operation body 22, case 23 and so on may be provided in an operating portion of an electronic apparatus on which switch 50 is mounted. Further, contacts 19A are connected to an electronic circuit (not shown) and so on, via the wiring patterns and first resistor element 24 (hereinafter, referred to as resistor 24). Further, contacts 19B are connected to a power supply (not shown) via the wiring patterns. In the above-described manner, an input device is constructed. The electronic circuit is configured of a microcomputer or the like.

In such a construction, when push button 21 is pressed downward as shown in FIG. 3A, rubber sheet 20 is bent downward as shown in FIG. 5. By rubber sheet 20 is bent, pressing portion 20A positioned on a lower surface of push button 21 presses movable contact 12 through cover sheet 11. When a predetermined pressing force is applied to movable contact 12, movable contact 12 is elastically deformed downward with a click feeling, and sheet 15 is bent downward. By sheet 15 is bent downward, conductive layer 14 positioned on the lower surface of sheet 15 comes in contact with contact 19A and contact 19B. Accordingly, contact 19A and contact 19B are electrically connected to each other through conductive layer 14. As shown in FIG. 5, the elastic deformation of movable contact 12 follows a deformation behavior in which the top portion of dome-shaped movable contact 12 is inverted in a reverse direction.

On the lower surface of conductive layer 14, high resistor layer 14B, which has minute surface irregularities formed on its lower surface, is formed. Therefore, when the pressing force applied to push button 21 increases, high resistor layer 14B is deformed by the applied pressing force. Then, the contact area between conductive layer 14 and contacts 19A, 19B increases. Therefore, the contact resistance value between contact 19A and contact 19B decreases, and an output voltage which is to be applied to the electric circuit changes via resistor 24.

The relationship between an operating load P and an output voltage V from resistor 24 with respect to the stroke of the pressing applied to push button 21 changes as shown in FIG. 6. That is, when push button 21 is pressed, movable contact 12 is elastically inverted at a predetermined stroke. Then, the operating load changes from P1 to P2. Immediately after the operating load changes from P1 to P2, conductive layer 14 comes in contact with contacts 19A, 19B. By conductive layer 14 comes in contact with contacts 19A, 19B, a voltage is output. At this time, with respect to a voltage of about DC 3V applied between contact 19A and contact 19B, a threshold voltage V1 through which the electronic circuit detects the electrical connection and disconnection is set to 0.2 to 0.3V. Accordingly, when an output voltage V2 slightly exceeding the threshold voltage V1 is generated, the electronic circuit detects the electrical connection between contact 19A and contact 19B. That is, the electric circuit detects that switch 50 is turned on.

When the gap L2 between conductive layer 14 and contacts 19A, 19B is excessively large, a stroke from the operating load P2 when movable contact 12 is elastically inverted to the output voltage V2 at which the electrical connection is detected increases. As a result, the operation touch feeling becomes sluggish. Therefore, it is preferable that the gap L2 is set in the range of 10 to 100 μm. More preferably, the gap L2 is set in the range of 20 to 40 μm.

When push button 21 is strongly pressed, the operating load P increases again, and simultaneously the connection resistance value between contact 19A and contact 19B decreases. Accordingly, the output voltage V curvedly increases. As such, the change in connection resistance value between contact 19A and contact 19B is easily detected by the electronic circuit.

When the pressing force applied to push button 21 is released, movable contact 12 elastically restores upward by an elastic restoring force of the movable contact 12. Similarly, sheet 15 also restores to an original state by an elastic restoring force thereof. Therefore, conductive layer 14 is separated from contacts 19A, 19B such that the electrical connection between contact 19A and contact 19B is cut off.

At a point of time when the output voltage V decreases to the threshold voltage V1 or less, the electronic circuit detects the electrical disconnection between contact 19A and contact 19B. That is, the electronic circuit detects that switch 50 is turned off.

As shown in FIG. 3B, when operation body 22 is swung in the top and lower direction or in the left and right direction, top and lower or left and right movable contacts 12 are elastically inverted with a click feeling. Accordingly, sheet 15 corresponding to the position of elastically-inverted movable contact 12 is bent downward. By sheet 15 is bent downward, conductive layer 14 comes in contact with contacts 19A, 19B. Further, as the swing operation of operation body 22 performed in the top and lower direction or in the left and right direction is released, conductive layer 14 is separated from contacts 19A, 19B. Accordingly, the electrical connection or disconnection between contact 19A and contact 19B is carried out. That is, switch 50 is turned on or off.

Through the pressing operation of push button 21 or the swing operation of operation body 22, the electronic circuit detects the electrical connection and disconnection among the plurality of contacts 19A, 19B or the change in connection resistance value between contact 19A and contact 19B. For example, as shown in FIG. 7A, when operation body 22 is swung upward in a state where a plurality of menus for music selection are displayed on display screen 30 of an electronic apparatus, the electrical connection and disconnection between contact 19A and contact 19B located at a place corresponding to swung operation body 22 is detected by the electronic circuit. Accordingly, cursor 31 displayed on display screen 30 is moved upward by one step. Display screen 30 is composed of a liquid crystal display element or the like.

When operation body 22 is continuously pressed by a certain pressing force, the connection resistance value between contact 19A and contact 19B changes. That is, the electronic circuit detects the output voltage V output via resistor 24 such that cursor 31 is continuously moved upward. When operation body 22 is strongly pressed in such a manner that the connection resistance value between contact 19A and contact 19B significantly changes, the moving speed of cursor 31 increases.

Alternatively, as shown in FIG. 7B, when operation body 22 is swung upward in a state where a map menu is displayed on display screen 30, pointer 32 is moved upward by one step through only one operation. Further, when operation body 22 is continuously pressed, pointer 32 is continuously moved upward. Further, when operation body 22 is operated by a strong force, the moving speed of pointer 32 increases.

As such, in a state where cursor 31 or pointer 32 is moved in the top and lower direction or in the left and right direction so as to be positioned on a desired menu or map, push button 21 is pressed. Then, as the electronic circuit detects that push button 21 is pressed, the selection is then finalized. Such an operation switches display screen 30 into a screen displaying a plurality of music titles or a screen displaying an expanded map of the selected position on the map.

In other words, the turn-on/off of the plurality of contacts 19A, 19B, that is, the electrical connection and disconnection among them is detected in accordance with the swing operation of operation body 22 or the pressing operation of push button 21. After that, by the swing operation or pressing operation is continuously performed, the connection resistance value between contact 19A and contact 19B changes, and the electronic circuit detects the change in connection resistance value. Accordingly, in accordance with the electric connection and disconnection between contact 19A and contact 19B or the change in connection resistance value, the movement amount or the moving speed of cursor 31 or pointer 32 is varied. As described above, various operations are realized in the electronic apparatus having switch 50 mounted thereon.

In movable contact element 17 according to the present invention, substantially dome-shaped movable contact 12 made of a conductive thin metal plate is bonded to the lower surface of cover sheet 11. Further, movable contact element 17 is constructed by bonding cover sheet 11 to the top surface of sheet 15. Further, switch 50 is constructed by bonding movable contact element 17 to the top surface of substrate 18 on which contact 19A and contact 19B facing each other are formed. Accordingly, the electric connection and disconnection is performed with a click feeling caused by a pressing operation. Further, the change in connection resistance value between contact 19A and contact 19B, which occurs when pressing is continuously performed after the pressing operation, is also easily detected. Therefore, it is possible to obtain movable contact element 17, which has a simple structure and can be operated in various manners, and switch 50 using movable contact element 17.

Conductive layer 14 and contact 19A, 19B are disposed to face each other, with the predetermined gap L2 therebetween. Accordingly, the insulation between conductive layer 14 and contacts 19A, 19B is reliably secured. Further, as the gap L2 is set in the range of 10 to 100 μm, preferably, 20 to 40 μm, an excellent click touch feeling of movable contact 12 and the electrical connection and disconnection without a time lag are realized.

The electronic circuit detects the electrical connection and disconnection between contact 19A and contact 19B by using the predetermined threshold voltage V1. Accordingly, the electrical connection and disconnection by switch 50 and the change in resistance value after the electrical connection and disconnection are detected without an error. As a result, the operation of the electronic apparatus having movable contact element 17 or switch 50 mounted therein is reliably performed.

As shown in FIG. 8B, fixed contact 19 formed on the top surface of substrate 18 may be constructed to have first fixed contact 19C (hereinafter, referred to as contact 19C) and second fixed contact 19D (hereinafter, referred to as contact 19D). Each of contact 19C and contact 19D has a comb shape such that the teeth of contacts 19C, 19D are alternately engaged with each other with the predetermined gap L1 therebetween. By each of contacts 19C, 19D has a comb shape, a change in connection resistance value between contact 19C and contact 19D is stably detected, even when a slight deviation in center position occurs between the central portion of conductive layer 14 and the gap L1.

In this embodiment, it has been described that each movable contacts 12 is bonded to the lower surfaces of corresponding cover sheets 11, and cover sheets 11 is bonded to the top surface of sheet 15. However, movable contact element 17 may be constructed in such a manner that the plurality of movable contacts 12 are bonded to the lower surface of one large cover sheet 11, and cover sheet 11 is bonded to the top surface of sheet 15. In this case, it is possible to obtain the same actions and effects.

Further, the construction of the composite switch has been described, in which the plurality of movable contacts 12 are loaded on the top surface of sheet 15, and movable contacts 12 are pressed or swung by push button 21 or operation body 22. However, a variety of switches such as a single push switch and a seesaw switch which can be swung in the left and right direction may be used. In this case, it is possible to obtain the same actions and effects.

Further, the construction of sheet 15 has been described, in which low resistor layer 14A and high resistor layer 14B are stacked on the lower surface of base sheet 13, thereby forming conductive layer 14. However, pressure sensitive conductive layer 14 or pressure sensitive conductive layer 15 obtained by dispersing conductive particles such as carbon into a base material such as silicone rubber may be used.

Second Embodiment

Hereinafter, a second embodiment of the present invention will be described with reference to FIGS. 9 to 11. In this embodiment, like reference numerals will be attached to the same components as those of the first embodiment, and the detailed descriptions thereof will be omitted.

Figure 9:
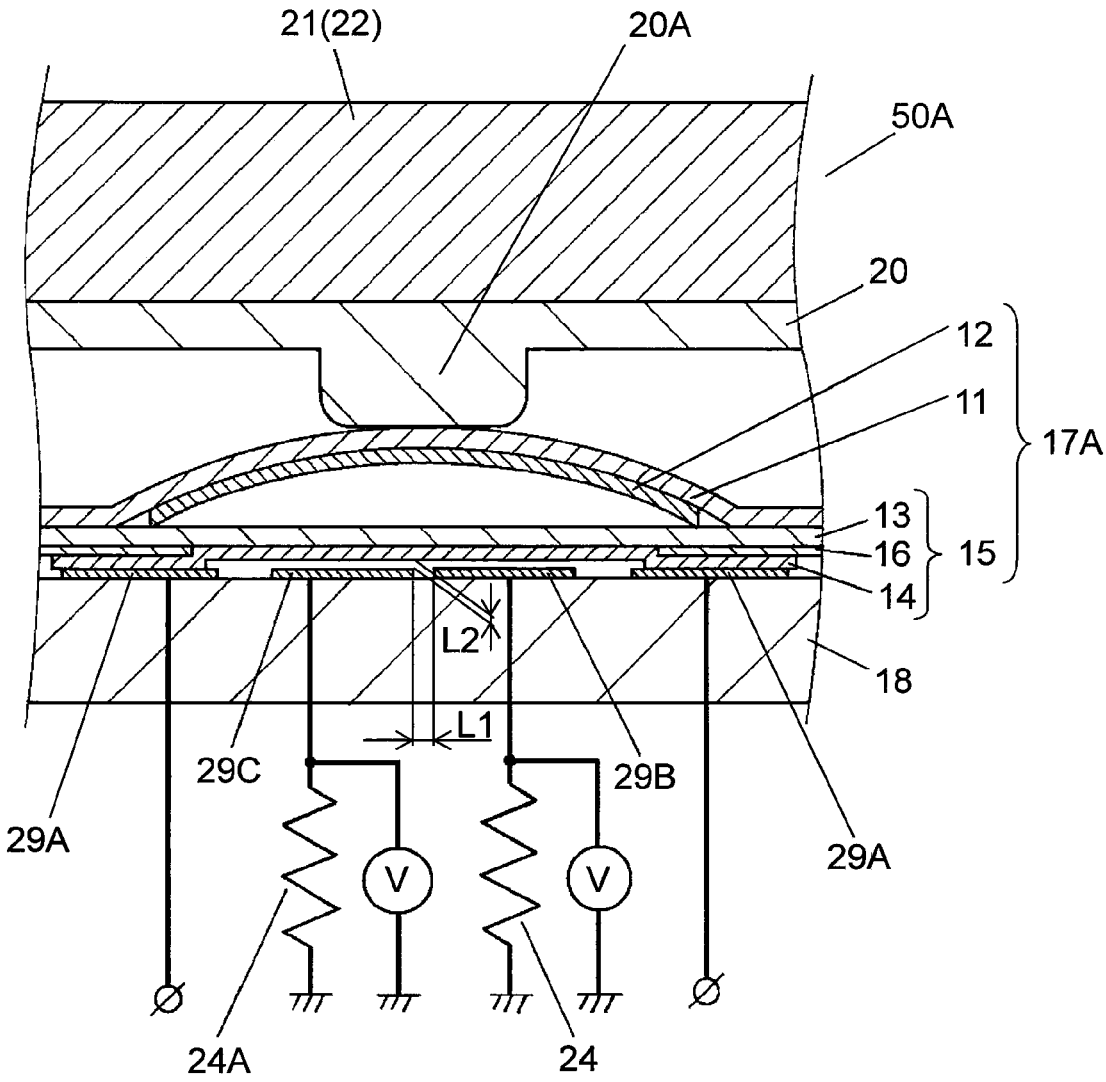
FIG. 9 is a cross-sectional view of a switch according to a second embodiment of the present invention.

FIG. 9 is a cross-sectional view of switch 50A according to a second embodiment of the present invention. FIG. 10 is a plan view of fixed contact 29 used in switch 50A. FIG. 11 is a graph showing characteristics of switch 50A.

Figure 10:
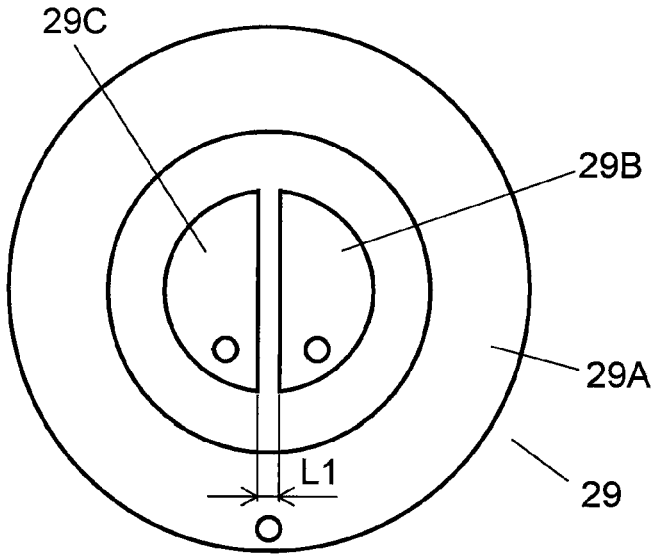
FIG. 10 is a plan view of a fixed contact used in the switch shown in FIG. 9.
Figure 11:
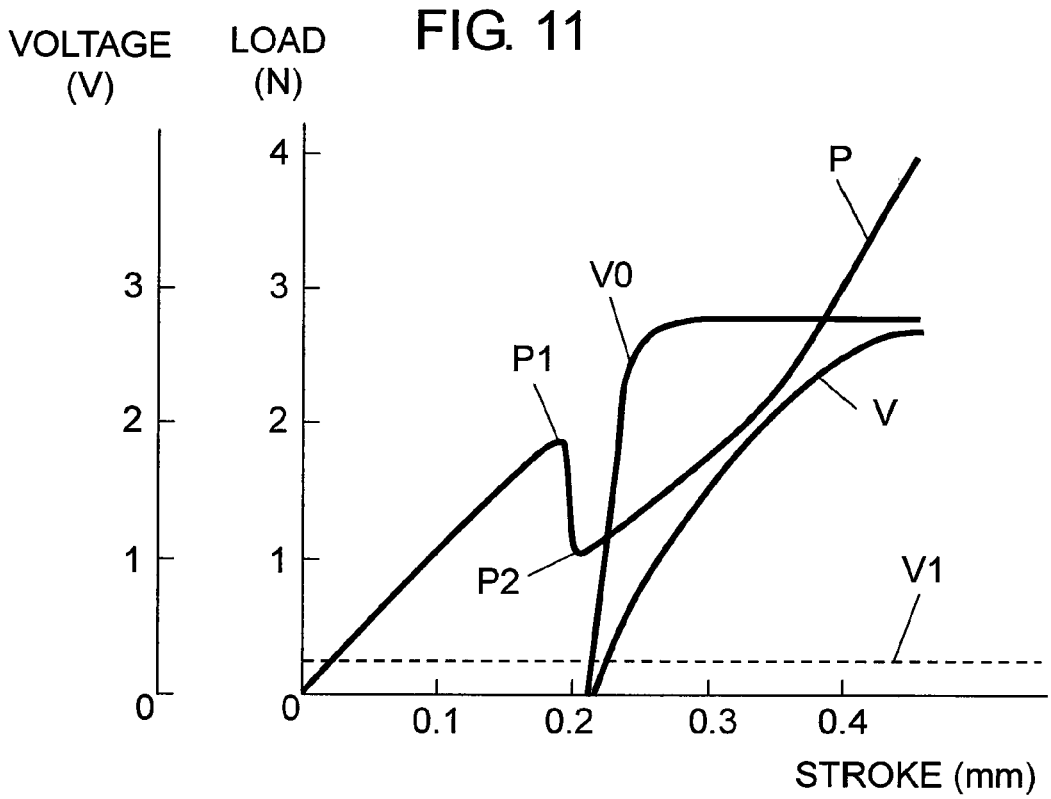
FIG. 11 is a graph showing characteristics of the switch shown in FIG. 9.

As shown in FIGS. 9 and 10, switch 50A has movable contacts 12 bonded to the lower surface of cover sheet 11. Further, in the switch 50A, cover sheets 11 are bonded to the top surface of pressure sensitive conductive sheet 15. Such a construction is the same as that of the first embodiment. In movable contact element 17A and switch 50A according to the second embodiment, the outer periphery of pressure sensitive conductive layer 14 is formed on a lower surface of insulating layer 16. Accordingly, movable contact element 17A is constructed in such a manner that the outer periphery of conductive layer 14 is exposed downward.

As shown in FIG. 10, substrate 18 has outer-periphery fixed contact 29A (hereinafter, referred to as contact 29A) formed on its top surface, contact 29A being formed in substantially a ring shape. Inside contact 29A, a pair of first central fixed contact 29B (hereinafter, referred to as contact 29B) and second central fixed contact 29C (hereinafter, referred to as contact 29C) are formed in a substantially semi-circular shape. Further, contact 29B and contact 29C are provided with a predetermined gap L1 formed therebetween. Fixed contacts 29 are constructed by contact 29A, contact 29B, and contact 29C.

On the top surface of substrate 18, movable contact element 17A is loaded. Movable contact element 17A has cover sheets 11, movable contacts 12, and sheet 15. Further, the central portion of conductive layer 14 disposed on the lower surface of sheet 15 faces contacts 29B, 29C with a predetermined gap L2 formed therebetween. The outer periphery of the lower surface of conductive layer 14 is loaded on contact 29A so as to come in contact with contact 29A. Accordingly, conductive layer 14 and contact 29A are electrically connected to each other at all times.

Switch 50A constructed in such a manner is mounted on the operating portion of the electronic apparatus. Contact 29B is connected to the electronic circuit of the electronic apparatus via first resistor element 24 from wiring patterns. Similarly, contact 29C is connected to the electronic circuit of the electronic apparatus via second resistor element 24A (hereinafter, referred to as resistor 24A). Further, contact 29A is connected to the power supply. In such a manner, the input device is constructed. Resistor 24A has a larger electric resistance value than resistor 24.

In the above-described construction, when operation body 22 is swung or push button 21 is pressed, rubber sheet 20 is bent downward. By rubber sheet 20 is bent, pressing portion 20A positioned at the place where the swing or pressing operation is performed presses movable contact 12 through cover sheet 11. When a predetermined pressing force is applied to movable contact 12, movable contact 12 is elastically deformed downward with a click feeling such that sheet 15 is bent downward. By sheet 15 is bent downward, the lower surface of conductive layer 14 comes in contact with contacts 29B, 29C. Accordingly, contact 29B and contact 29C are electrically connected to each other through conductive layer 14. Further, a power supply current is supplied to contact 29A from the power supply. Accordingly, contacts 29A, 29B, 29C are electrically connected to one another through conductive layer 14. Further, the elastic deformation of movable contact 12 is such a deformation behavior that the top portion of dome-shaped movable contact 12 is inverted in the reverse direction.

After that, when a pressing force is further applied to operation body 22 or push button 21, similarly to the constitutions of the first embodiment, the contact area between conductive layer 14 and contacts 29B, 29C increases, and the connection resistance value between conductive layer 14 and contact 29B and between conductive layer 14 and contact 29C decreases. Accordingly, as shown in FIG. 11, the output voltage V in a curved line is output to the electronic circuit from resistor 24 at contact 29B side, similarly to the constitutions of the first embodiment. On the contrary, an output voltage V0 from the side of contact 29C changes in a nearly vertical line. That is, the output voltage V0 is output to the electronic circuit as if the electrical connection of switch 50A from off to on is performed. This is because resistor 24A connected to contact 29C has a larger resistance value than resistor 24.

In the second embodiment, although the threshold voltage V1 is not applied, the detection of electrical connection and disconnection of switch 50A is accurately performed by the output voltage V0 from the side of contact 29C. That is, immediately after or before movable contact 12 is elastically inverted and the operating load changes from P1 to P2, the detection of electrical connection and disconnection of switch 50A, which is referred to as electrical turn-on/off, is accurately performed by the output voltage V0. Further, even when a certain level of variation is present in the threshold voltage V1, the detection of electrical connection and disconnection of switch 50A is accurately performed.

That is, immediately after or before movable contact 12 is elastically inverted by the output voltage V0 from the side of contact 29C, the detection of electrical connection and disconnection is performed. Further, the change in connection resistance value between contact 29B and contact 29C, which is generated by an operation after the detection of electrical connection and disconnection, is detected by the electronic circuit through the output voltage V from the side of contact 29B.

The electronic circuit detects the electrical connection and disconnection among the plurality of contacts 29A, 29B, 29C or the change in connection resistance value, which is generated by the pressing operation of push button 21 or the swing operation of operation body 22. That is, as shown in FIGS. 7A and 7B, the movement amount or moving speed of cursor 31 or pointer 32 is varied, for example. Accordingly, various operations can be performed on the electronic apparatus.

According to the second embodiment, contact 29B and contact 29C are disposed in the central portion of conductive layer 14 so as to face each other with the predetermined gap L1 therebetween. Further, the outer periphery of conductive layer 14 is connected to contact 29A. Accordingly, in addition to the same effect as that of the first embodiment, the detection of electrical connection and disconnection of switch 50A is more reliably performed, immediately after or before movable contact 12 is elastically inverted.

Further, the outer periphery of movable contact 12 is loaded above the outer periphery of conductive layer 14 which comes in contact with contact 29A. Therefore, when the above-described pressing or swing operation is performed, the outer periphery of the lower surface of conductive layer 14 is pressed against a top surface of contact 29A by the outer periphery of movable contact 12. Accordingly, the electrical connection of switch 50A is reliably performed.

Figure 12:
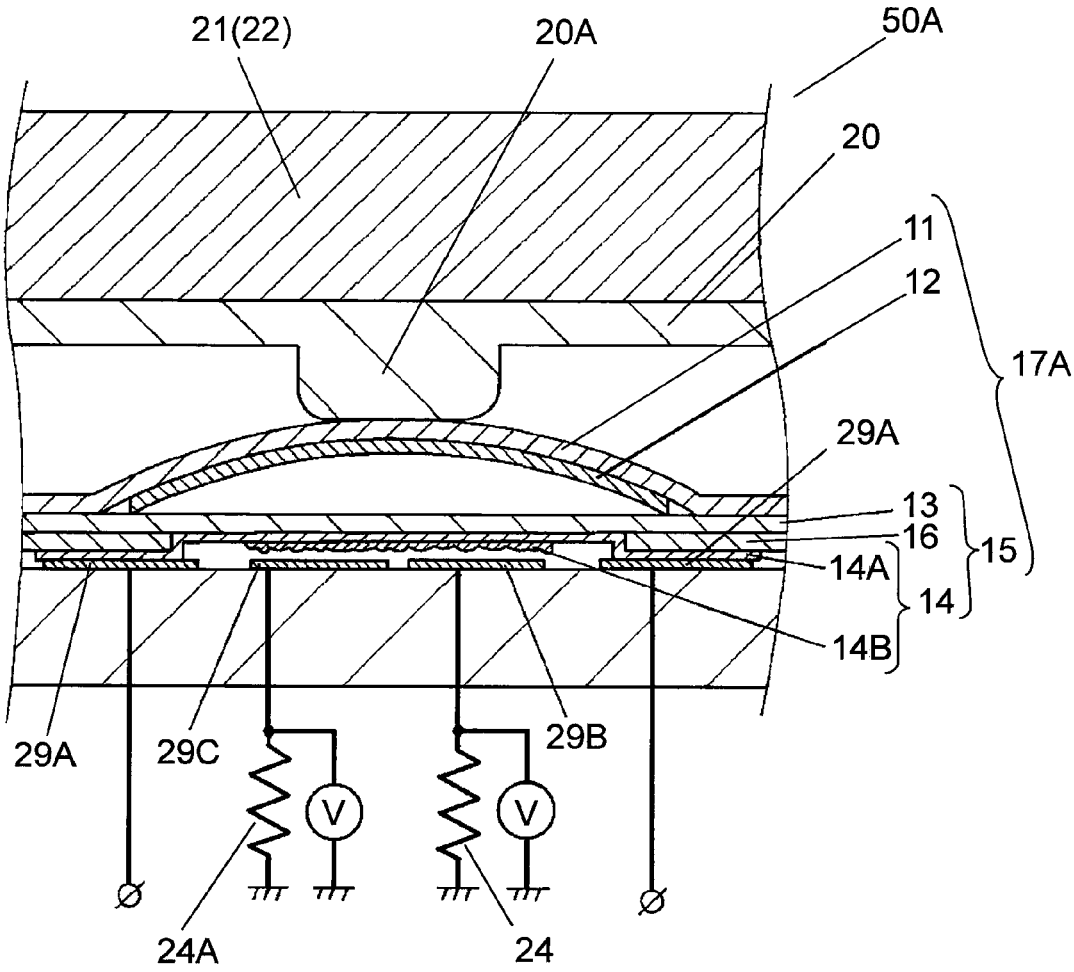
FIG. 12 is a cross-sectional view of another type of switch according to the second embodiment of the present invention.

As shown in FIG. 12, low resistor layer 14A may be formed to extend to a lower side of the outer periphery of movable contact 12, and high resistor layer 14B may be formed only at the central portion of conductive layer 14. By conductive layer 14 constructed in such a manner is used, the connection between conductive layer 14 and contact 29A is achieved through low resistor layer 14A, not high resistor layer 14B, at all times. Therefore, the connection between conductive layer 14 and contact 29A exhibits a stable connection resistance value. That is, when the pressing operation is performed, for example, the outer periphery of movable contact 12 presses the outer periphery of low resistor layer 14A. However, although the pressing force increases, the connection resistance value between lower resistor layer 14A and contact 29A hardly changes. Accordingly, the change in connection resistance value between conductive layer 14 and contact 29A is prevented from having an effect upon the output voltage V. Therefore, a stable change in connection resistance value is detected, which is caused by only high resistor layer 14B and contacts 29B, 29C in the central portion.

Figure 13:
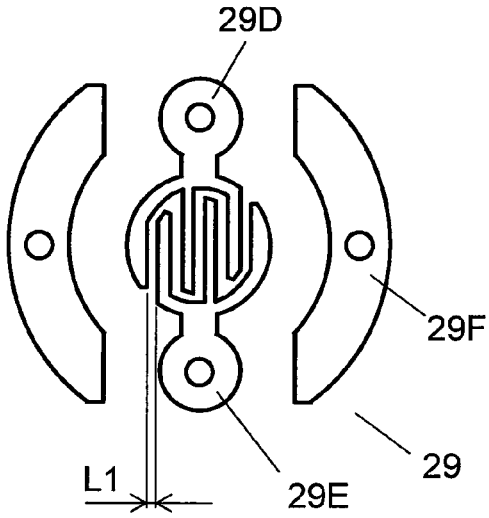
FIG. 13 is a plan view of another type of fixed contact used in the switch according to the second embodiment of the present invention.

As shown in FIG. 13, fixed contact 29 formed on the top surface of substrate 18 may have first central fixed contact 29D (hereinafter, referred to as contact 29D), second central fixed contact 29E (hereinafter, referred to as contact 29E), and outer-periphery fixed contact 29F. Each of contact 29D and contact 29E has a comb shape such that the teeth of contacts 29D, 29E are alternately engaged with each other with the predetermined gap L1 therebetween. By each of contacts 29D, 29E has a comb shape, a change in connection resistance value is stably detected, even when a slight deviation in center position occurs between the central portion of conductive layer 14 and the gap L1.

Figure 14A:
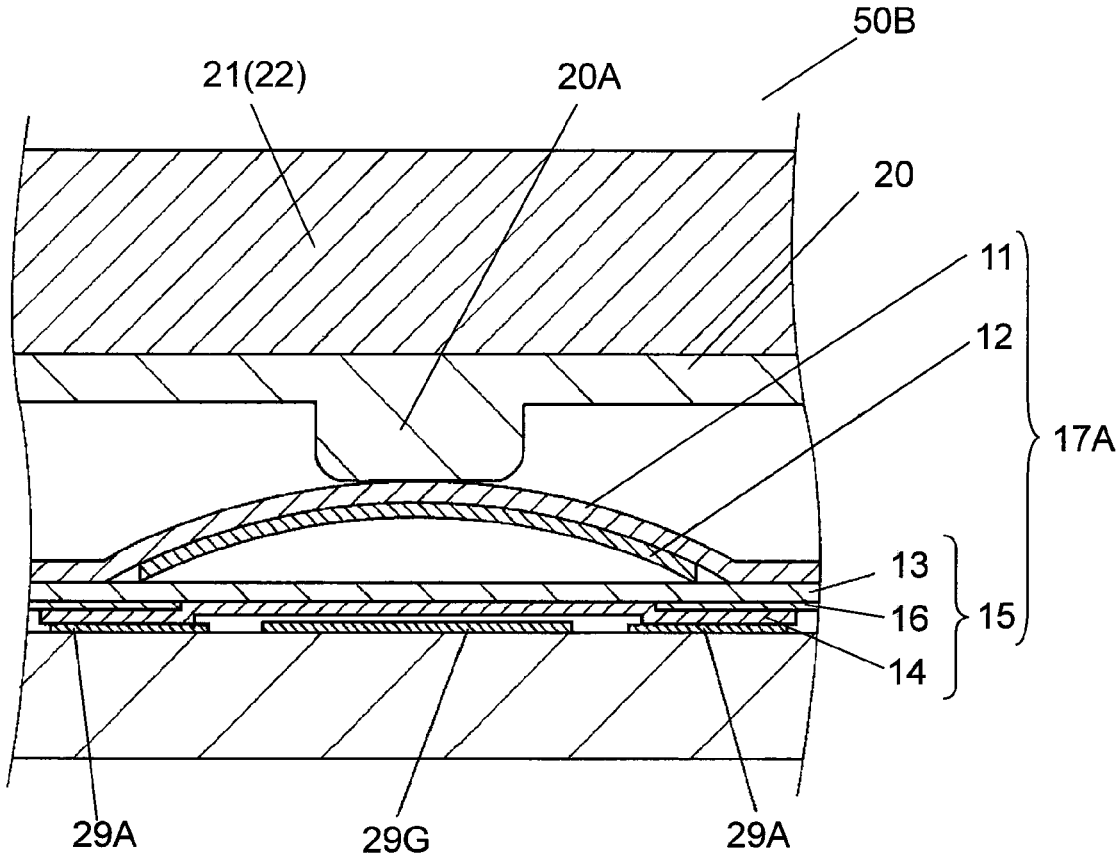
FIG. 14A is a cross-sectional view of yet another type of switch according to the second embodiment of the present invention.
Figure 14B:
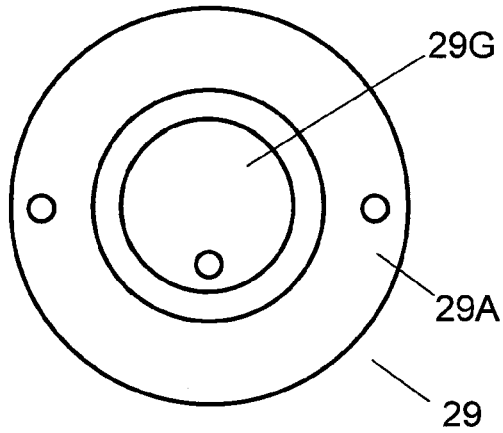
FIG. 14B is a plan view of a fixed contact used in the switch shown in FIG. 14A.
Figure 15:
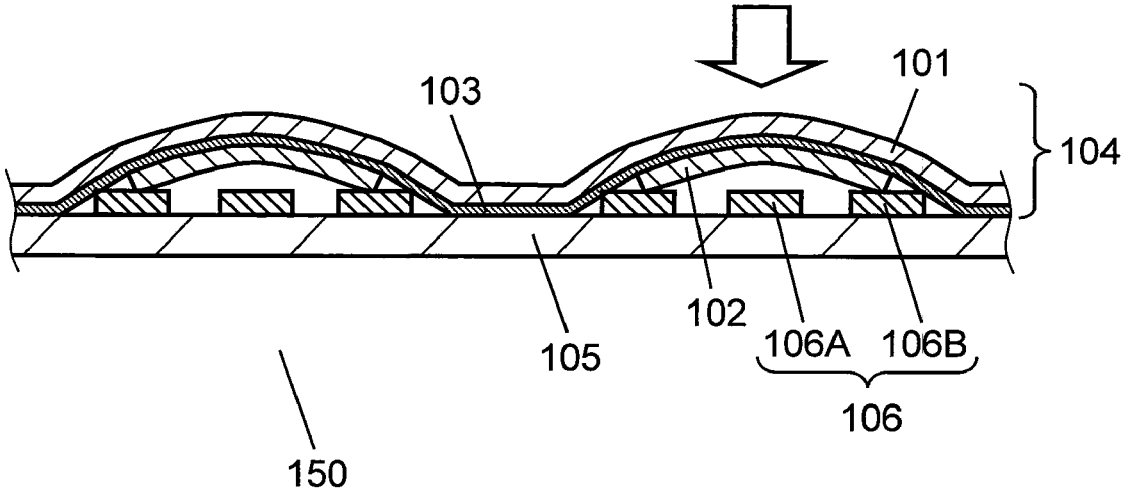
FIG. 15 PRIOR ART
FIG. 15 is a cross-sectional view of a conventional switch.

As shown in FIGS. 14A and 14B, fixed contact 29 may have one central fixed contact 29G (hereinafter, referred to as contact 29G) and outer-periphery fixed contact 29A. Contact 29G is formed in a substantially circular shape.

As shown in FIGS. 14A and 14B, contact 29G positioned at the central portion has only one large sized contact shape. Accordingly, a contact area between contact 29G and conductive layer 14 has wider. As a result, a change of a contact resistor between contact 29G and conductive layer 14 is prevented from variety, so that it is more desirable. Contact 29A is formed in substantially a ring shape which surrounds contact 29G. Switch 50B is constructed in such a manner that movable contact element 17A is loaded above fixed contact 29. Although such a construction is used, the embodiment of the present invention can be implemented. Further, contact 29A may be formed in substantially a horseshoe shape which surrounds contact 29G. When fixed contact 29 is composed of contacts 29A, 29G, the detection of the threshold voltage V1 may be performed by the electronic circuit, similarly to the first embodiment.

In this embodiment, it has been described that each movable contact 12 is bonded to the lower surface of corresponding cover sheet 11, and cover sheet 11 is bonded to the top surface of sheet 15. However, movable contact element 17A may be constructed in such the manner that the plurality of movable contacts 12 are bonded to the lower surface of one large cover sheet 11, and cover sheet 11 is bonded to the top surface of sheet 15. In this case, it is possible to obtain the same actions and effects.

Further, the construction of the composite switch has been described, in which the plurality of movable contacts 12 are loaded on the top surface of sheet 15, and movable contacts 12 are pressed or swung by push button 21 or operation body 22. However, the variety of switches such as the single push switch and the seesaw switch which can be swung in the left and right direction may be used. In this case, it is possible to obtain the same actions and effects.

Further, the construction of sheet 15 has been described, in which low resistor layer 14A and high resistor layer 14B are stacked on the lower surface of base sheet 13, thereby forming conductive layer 14. However, pressure sensitive conductive layer 14 or pressure sensitive conductive layer 15 obtained by dispersing conductive particles such as carbon into the base material such as silicone rubber may be used.

What is claimed is:

1. A switch comprising:

a substrate;

a movable contact element including: a movable contact having a dome shape;

a cover sheet having the movable contact bonded to its lower surface; and a pressure sensitive conductive sheet having the cover sheet stacked on its top surface;

and a fixed contact that is formed on a top surface of the substrate such that a top surface of the fixed contact faces a lower surface of the pressure sensitive conductive sheet, the pressure sensitive conductive sheet including a low resistor layer and a high resistor layer having a larger resistance value than the low resistor layer, wherein the fixed contact has an outer-periphery fixed contact, a first central fixed contact and a second central fixed contact, the pressure sensitive conductive sheet comes in contact with the first central fixed contact and the second central fixed contact by deforming the movable contact elastically, a first resistor element is connected to the first central fixed contact, and a second resistor element is connected to the second central fixed contact, the second resistor element having a larger electric resistance value than the first resistor element.

2. The switch of claim 1, wherein the low resistor layer, where carbon powder is dispersed into synthetic resin, has a sheet resistance value of 0.5 to 30 kΩ/□.

3. The switch of claim 1, wherein the high resistor layer has surface irregularities and has a sheet resistance value of 50 kΩ/□to 5 MΩ/□.

4. The switch of claim 1, wherein each of the first central fixed contact and the second central fixed contact has a comb shape such that teeth of the first central fixed contact and the second central fixed contact are alternately arranged with each other with a predetermined gap therebetween.

5. The switch of claim 1, wherein the pressure sensitive conductive sheet and the outer-periphery fixed contact are electrically connected to each other at all times.

* * * * *